US011079163B2

(12) United States Patent
Bostic, Jr. et al.

(10) Patent No.: US 11,079,163 B2
(45) Date of Patent: Aug. 3, 2021

(54) METHOD FOR CONTROLLING DEFROST IN REFRIGERATION SYSTEMS

(71) Applicant: Standex International Corporation, Salem, NH (US)

(72) Inventors: Teddy Glenn Bostic, Jr., Summerville, SC (US); Gregory Joseph Deutschmann, Mt. Pleasant, SC (US); Chang H. Luh, Summerville, SC (US); Laura Steiner, Mt. Pleasant, SC (US)

(73) Assignee: Standex International Corporation, Salem, NH (US)

( * ) Notice: Subject to any disclaimer, the term of this patent is extended or adjusted under 35 U.S.C. 154(b) by 157 days.

(21) Appl. No.: 16/444,445

(22) Filed: Jun. 18, 2019

(65) Prior Publication Data

US 2020/0003480 A1 Jan. 2, 2020

Related U.S. Application Data

(60) Provisional application No. 62/690,385, filed on Jun. 27, 2018.

(51) Int. Cl.
*F25D 21/12* (2006.01)
*F25D 21/00* (2006.01)

(52) U.S. Cl.
CPC ..... *F25D 21/12* (2013.01); *F25D 21/006* (2013.01)

(58) Field of Classification Search
CPC ..... F25D 21/12; F25D 21/006; F25D 21/08; F25D 21/008; F25D 17/06; F25D 11/006; F25D 2700/10; F25D 2500/02
See application file for complete search history.

(56) References Cited

U.S. PATENT DOCUMENTS 5,269,149 A * 12/1993 Zeidler ..... A23B 4/06 62/239
6,427,463 B1 * 8/2002 James ..... F25B 5/04 62/186
2005/0226735 A1 * 10/2005 Funami ..... F04B 39/023 417/211.5
2013/0000336 A1 * 1/2013 Hagiwara ..... F25D 31/005 62/159
2013/0048647 A1 * 2/2013 Farrar ..... B65D 88/745 220/592.01
2015/0091430 A1 * 4/2015 Popovitch ..... F25D 25/02 312/408

(Continued)

FOREIGN PATENT DOCUMENTS

JP 10185397 A * 7/1998

OTHER PUBLICATIONS

Centers for Disease Control and Prevention, "Vaccine-Preventable Diseases", Apr. 2013, Epidemology and Prevention, 13th Edition, pp. 63-77 (Year: 2013).*

*Primary Examiner* — Kun Kai Ma
(74) *Attorney, Agent, or Firm* — Saxton & Stump, LLC

(57) ABSTRACT

Automatic defrost technology for refrigeration equipment, in particular, defrosting refrigeration equipment by acceleration defrosting sublimation effects in refrigeration chambers in continual operation below the freezing point of water. Useful for refrigeration equipment for storage of vaccines and other products having storage temperatures ranging from −58 degrees Fahrenheit and 5 degrees Fahrenheit.

10 Claims, 6 Drawing Sheets

(56) References Cited

U.S. PATENT DOCUMENTS

| | | | | |
|---|---|---|---|---|
| 2015/0323237 | A1* | 11/2015 | Kim | F25D 17/062 62/66 |
| 2016/0286998 | A1* | 10/2016 | Lindbo | G07F 9/105 |
| 2016/0290713 | A1* | 10/2016 | Twiggar, III | E05D 7/00 |
| 2018/0180344 | A1* | 6/2018 | Takahashi | F25D 23/066 |
| 2019/0145693 | A1* | 5/2019 | Bostic, Jr. | A61J 1/165 62/151 |

* cited by examiner

METHOD FOR CONTROLLING DEFROST IN REFRIGERATION SYSTEMS

This application claims benefit of U.S. Provisional Application Ser. No. 62/690,385 filed Jun. 27, 2018 pursuant to 35 USC § 119(e).

FIELD OF THE INVENTION

This invention relates to automatic defrost technology for refrigeration equipment, in particular, defrosting refrigeration equipment by acceleration defrosting sublimation effects in refrigeration chambers in continual operation below the freezing point of water.

BACKGROUND OF THE INVENTION

In standard refrigeration equipment, the heat absorbing element of the cooling technology and other cooled surfaces will continually accumulate frost from atmospheric moisture rendering the system less efficient and inconvenient to maintain. A variety of automated defrost technologies are employed to eliminate frost buildup but these generally require heating the surfaces for a brief period thus raising the air and product temperature within the freezer. For some devices, this temperature variation exceeds the acceptable limits required to maintain product viability.

In the area of scientific refrigeration, there exists an operational challenge that limits the usage of freezers that utilize industry standard defrost technologies. Standard defrost technologies heat the interior of the freezer compartment temporarily to the point that the frost layer evaporates or drains away. For some products requiring refrigeration, such as vaccines, this temperature variation exceeds the acceptable limits required to maintain product viability. For example, the Centers for Disease Control (CDC) recommend that if a manual defrost freezer is used then another freezer storage unit that maintains the appropriate temperature must be available during the defrost period. Also, frost-free or automatic defrost cycles are preferred. Vaccine refrigeration storage must maintain consistent temperatures between −58 degrees Fahrenheit and 5 degrees Fahrenheit. (Between −50 degrees Centigrade and −15 Degrees Centigrade). The American Academy of Pediatrics recommends storing vaccines not warmer than minus 15 degrees Celsius plus or minus five degrees Celsius, even during defrost cycles.

There is not found in the prior art a method for controlling the temperature variations in a freezer during the defrost cycle that can be utilized in many standard freezer systems consisting of simple or elaborate variations of refrigerant evaporation, thermo-electric, controlled gas expansion or other cooling technologies and meets the temperature requirements.

The disclosed method utilizes temperature variation moderating heat reservoirs consisting of high specific or latent heat capacity materials to significantly reduce the cycle temperature variation while maintaining the ability to successfully defrost the freezer. This method also utilizes a secondary chamber and plenum outside of the evaporator chamber to regulate airflow, contain the heat reservoirs and thermally isolate the product chamber. An additional benefit is also realized in the event of a disruption or reduction in the cooling capacity (power outage, compressor failure, etc.) of the heat absorbing element of the cooling technology extending the amount of time the reduction can be tolerated without affecting the quality of the product contained within the freezer.

SUMMARY OF THE INVENTION

It is an aspect of the invention to provide a refrigeration defrost system that is suitable for use in low temperature units suitable for storage of vaccines and other products.

Another aspect of the invention is to provide a refrigeration defrost system that never results in a temperature rise of more than 5 degrees Centigrade even during defrost mode.

Still another aspect of the invention is to provide a refrigeration defrost system that can be adapted for any freezer.

Another aspect of the invention is to provide a refrigeration defrost system wherein the temperature variance moderation chamber can be constructed of either plastic or metal.

Still another aspect of the invention is to provide a defrost system that in the event of a disruption or reduction in the cooling capacity (power outage, compressor failure, etc.) of the heat absorbing element of the cooling technology wherein extending the amount of time the reduction in cooling capacity can be tolerated.

Finally, and most importantly, it is an aspect of the invention to provide a defrost system that is an accelerated sublimation process driven by higher than average total-cycle vapor partial pressure differences than is found in prior art two-chamber auto-defrost systems.

DETAILED DESCRIPTION OF THE INVENTION

The invention generally relates to the field of hybrid refrigeration and the ability to precisely control the temperature, moderate temperature due to heating processes, extend passive temperature control timeframes, better assure product quality and reduce manual maintenance requirements. Refrigeration systems typically rely on intermittent heating cycles to eliminate the accumulation of frost. Typical defrosting technologies raise the temperature of the air within the freezer to levels unacceptable for certain applications due to this heating cycle.

Figure 1:
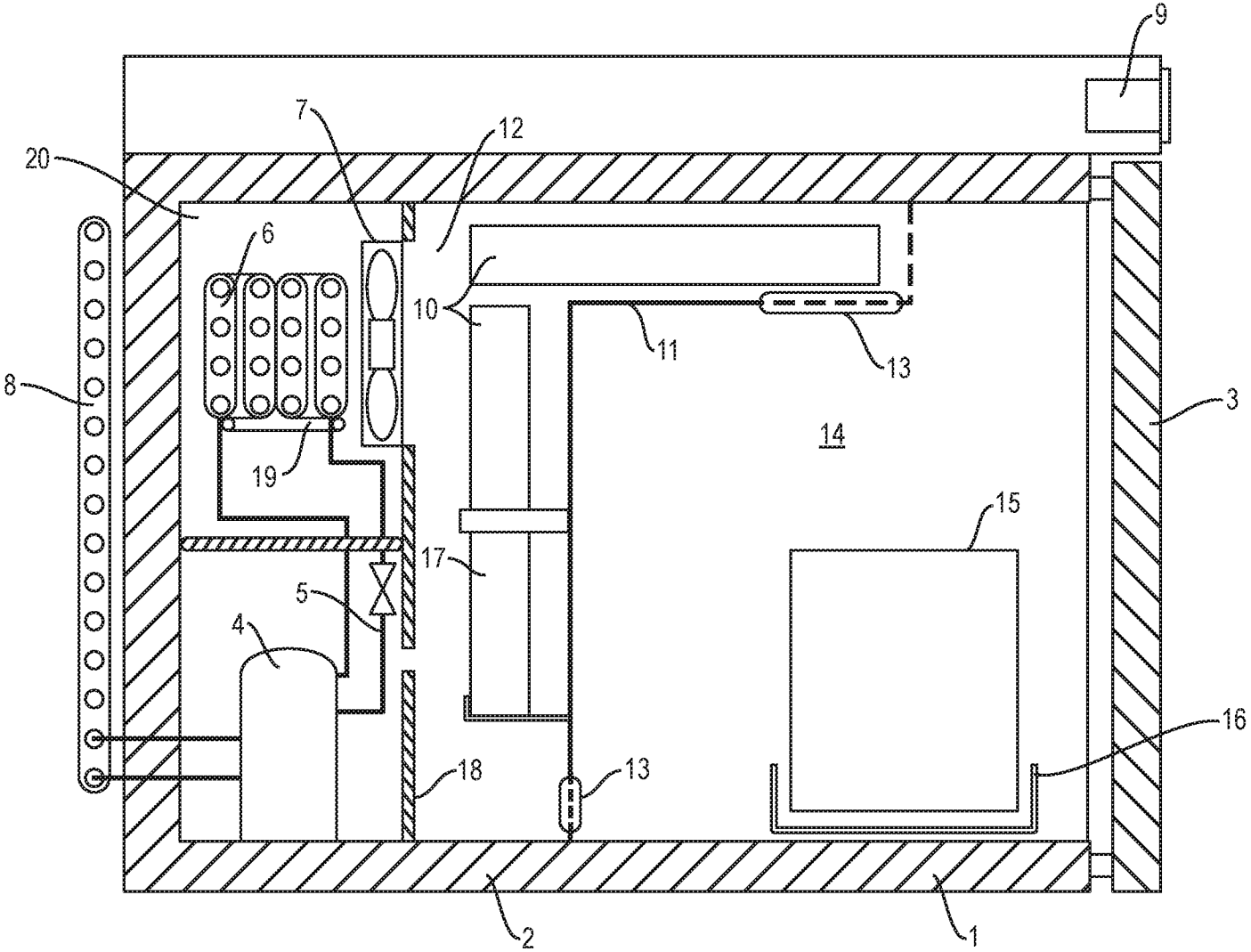
FIG. 1 is an illustration of the preferred embodiment in accordance with the invention.

Referring now to FIG. 1, the preferred embodiment of the invention is illustrated. The refrigeration system is standard with the exception of the defrost invention. The system features typical condenser 8 which has approximately 180" to 240" linear inches of metal tubing approximately 0.16" in diameter. The system also has a hermetically sealed compressor 4. Compressor 4 is preferably Model TT1112NY as made by Jiaxipera. Although similar compressors such as made by Copland Corporation or Tecumseh Corporation would also be suitable.

Evaporator 6 is approximately 80 to 160 linear inches of metal tubing approximately 0.25 inches in diameter with fins for heat transfer and integrated evaporator heating element 19 and expansion device 5 such as an orifice or small diameter tube residing within the evaporator chamber 20. Also included in the system is an axial airflow induction fan 7 approximately 3.50 inches in diameter, mounted on the chamber dividing wall 18 and digital controller 9 as manufactured by Dixell (part number XR70 or XR75) that measures chamber temperature and regulates refrigeration system operation. The evaporator heating element 19 is an electrically resistive component that becomes hot when subject to an electric current. The insulated freezer housing 1 is constructed of an inner and outer shell containing an insulating material 2. Access to the interior of the system is provided by a similarly insulated door 3.

Evaporator 6 is separated from the product storage chamber 14 by the temperature variance moderation chamber 12. Chilled air is circulated by the axial airflow induction fan 7.

Temperature variance moderation chamber 12 (the newly defined volume) can be constructed from plastic or metal.

Temperature variance moderation chamber (herein after "TVMC") 12 consists of a dividing plenum wall 11, with a plurality of integrated retaining clips 17, a plurality of vents 13 located to induce beneficial convection and sized to optimize the thermal transfer to the indicated thermal reservoirs 10. The four thermal reservoirs 10 are nominally 8.5 inch×7.5 inch×0.88 inch.

TVMC 12 is adjacent to the product storage chamber 14.

Product 15 is contained in product storage chamber 14. The product 15 can be stored loose or contained in trays or baskets 16.

Proportionalities and relationships between the various elements in this embodiment are critical to successful operation and are identified as follows:

Product storage chamber 14 volume relative to the temperature variance moderation chamber 12 volume ratio is nominally 4.6 having a tolerance zone of 3 to 5.5.

Product storage chamber 14 volume relative to the thermal reservoirs 10 total latent heat ratio is nominally 0.8 ($in^3/(J/g)$) having a tolerance zone of 0.1 to 1.5 ($in^3/(J/g)$).

Product storage chamber 14 area relative to dividing plenum wall 11 inward surface area ratio is nominally 3.1 having a tolerance zone of 1 to 10.

Dividing plenum wall 11 inward surface relative to the total thermal reservoir 10 surface area ratio is nominally 1.8 having a tolerance zone of 0.5 to 4.0.

Product storage chamber 14 is maintained at a minimum delta of 0° C. lower temperature to a maximum delta of −8° C. lower temperature than the freezing point of thermal reservoir 10.

Product storage chamber 14 is maintained at a minimum delta of 0° C. lower temperature to a maximum delta of −20° C. lower temperature than the recommended storage temperature when the stored product is frozen vaccine.

Thermal reservoirs 10 freezing point temperature is a minimum delta of 0° C. lower temperature to a maximum delta of −20° C. lower temperature than the recommended storage temperature of the stored product 15 when the stored product is vaccine.

At storage, the refrigeration systems draws down the temperature of the product storage chamber 14 using a typical vapor compression cycle utilizing R600, R290 or a mixture of the two as a refrigerant.

As temperature variance moderation chamber 12 and product storage chamber 14 temperature is reduced to the minimum operating range (typically −30° C.); thermal reservoirs 10 loose heat through the process and freeze.

When digital controller 9 initiates an automatic defrost cycle and the refrigeration system is inactive, thermal reservoirs 10 absorb heat via free convection in product storage chamber 14 and maintain the temperature of product storage chamber 14 below the critical vaccine storage temperature throughout the defrost cycle.

Critically, as a process parameter, axial airflow induction fan 7 will not engage until the air temperature around evaporator 6 and in the evaporator chamber 20 has dropped to between −5° C. and −20° C. after a defrost cycle.

Critically, thermal reservoirs 10 and plenum dividing wall 11 create a thermal barrier between evaporator 20 and product storage chamber 14 so the temperature increase induced by evaporator heating element 19 during a defrost cycle does not adversely affect the stored frozen vaccine 15.

The following definitions are used for the following description of the invention as shown in FIGS. 2-9:

$T_{EV}$1 is the temperature of evaporator 6 at State (i).

$T_{EVCH}$1 is the temperature of the air in evaporator 20 at State (ii).

$T_{TVMC}$ 1 is the temperature of the air in Temperature Variation Moderation Chamber ($T_{TVMC}$) 12 at State (i).

$T_{PRODCH}$1 is the temperature of the air in Product Chamber 14 at State (i).

Operational Cycle and Thermo-Physical Properties

Figure 2:
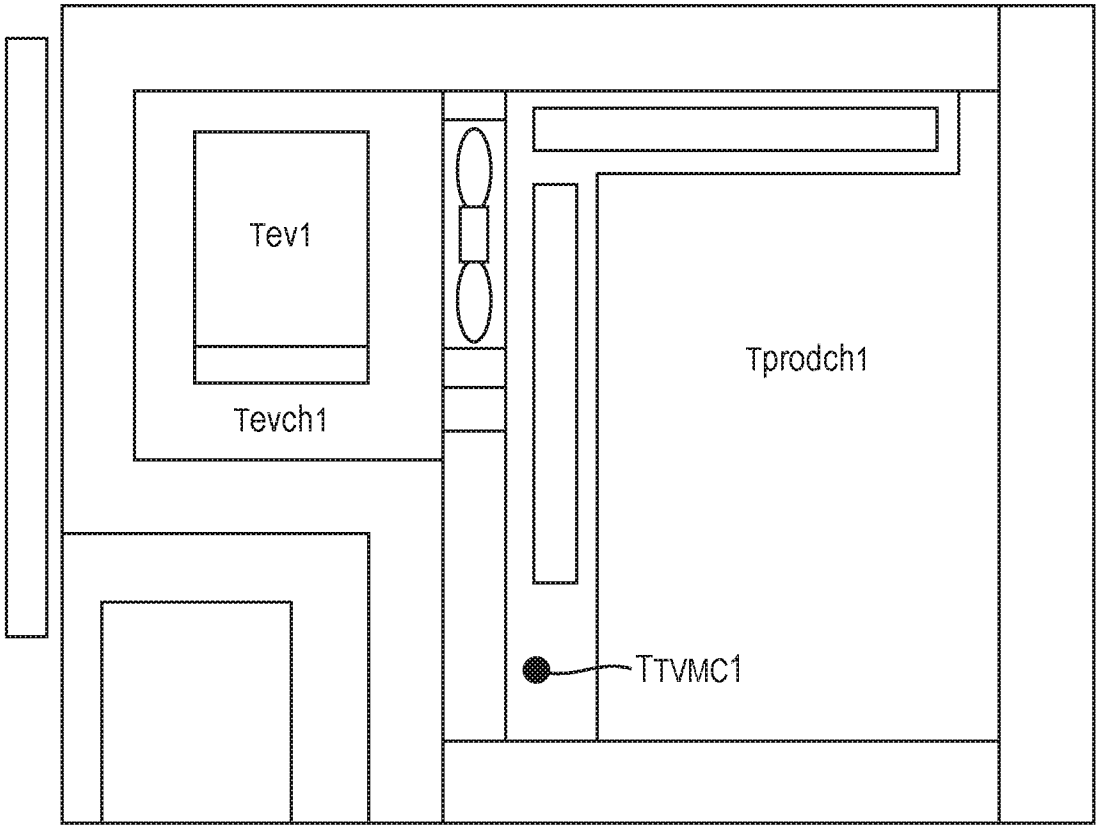
FIG. 2 is an illustration of normal steady-state operation of the refrigeration system between defrost cycles.
Figure 3:
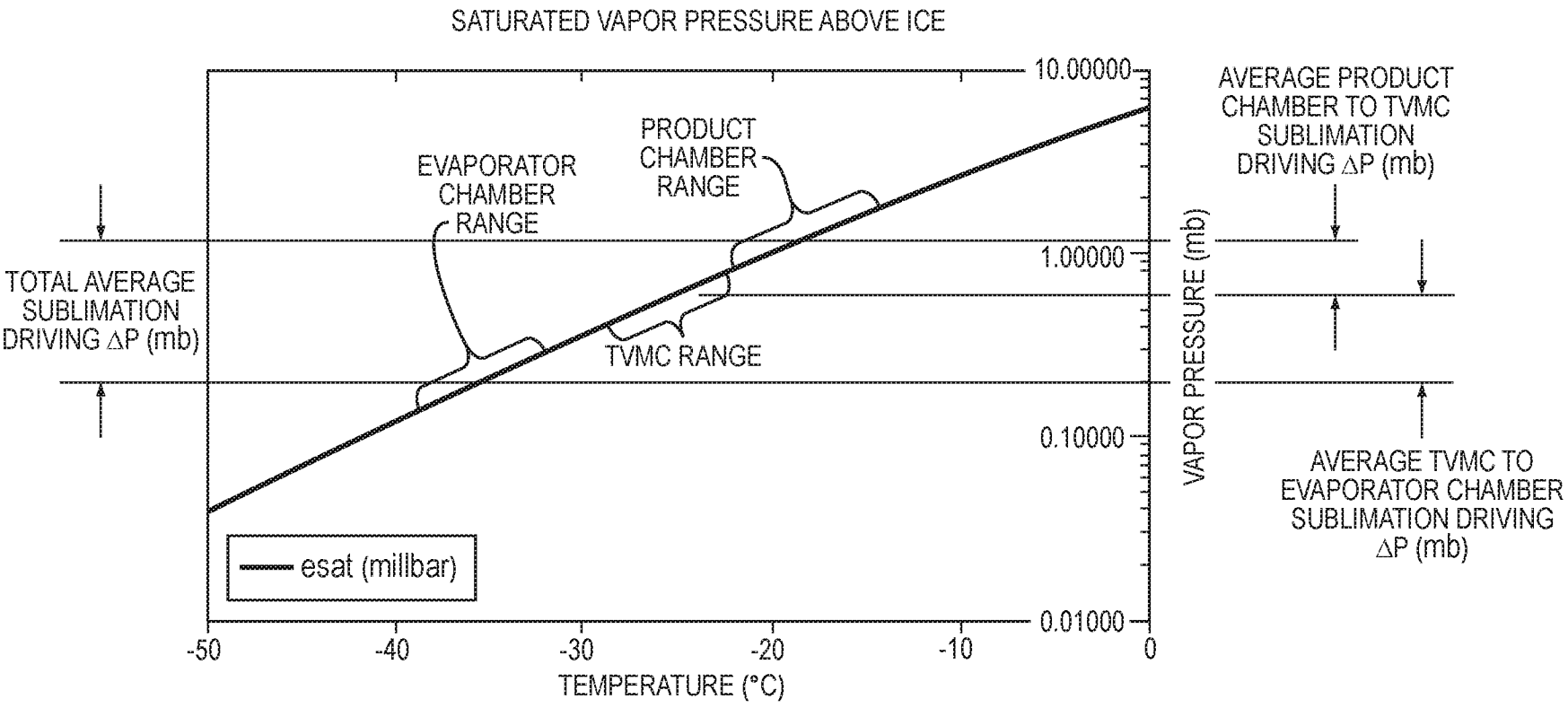
FIG. 3 is a graph of the vapor pressure in accordance with invention

Now referring to FIG. 2, the normal steady-state refrigeration operation between defrost cycles is shown. The system temperatures at State (i) is as follows: $T_{EV}$1 is the steady-state temperature at evaporator 6. This is the operating freezer temperature required to achieve the product temperature, that is, $T_{PRODCH}$1. $T_{EVCH}$1 temperature is greater than $T_{EV}$1 temperature while $T_{RVMC}$1 is greater than $T_{EVCH}$1. The $T_{PRODCH}$1 temperature is greater than $T_{TVMC}$ 1 but lower than the specified product storage temperature but is typically well below the freezing point of water at standard atmospheric conditions.

Process and Thermo-Physical Effects of State i

Frost builds up during normal operation within the product chamber 1, TVMC 12 and evaporator chamber 20. With water vapor sources coming from outgassing product content and door 3. Wherein, Openings of door 3 introduces warmer air with higher relative humidity into product storage chamber 14. Air properties become progressively more uniform over time throughout the system (primarily within TVMC 12, and product chamber 14) except in the immediate vicinity of evaporator 6. These areas are the coldest surfaces during steady-state operation. All other warmer surfaces stabilize due to active convection caused by fan 7. The air water vapor content becomes increasingly elevated over time for the target steady-state operating temperature of product storage chamber 14. This condition is due to continual sublimation while the system approaches the theoretical vapor saturation point. Thus, the sublimation rate is continually slowing but does continue until the ice source (frost buildup in product chamber 14 or TVMC 12) is depleted. Due to the situation where the wall temperatures and temperatures of evaporator 6 and evaporator chamber 20 being lower than the temperature of product chamber 14, there is a continuing transfer of sublimating ice mass from product chamber 14. This is deposited as frost on the colder surfaces in evaporator chamber 20. This deposition is due to relative differences of the vapor partial pressure in the immediate surrounding air in evaporator 6 as well as the other surfaces within the system.

Defrost Cycle

Figures 4, 5:
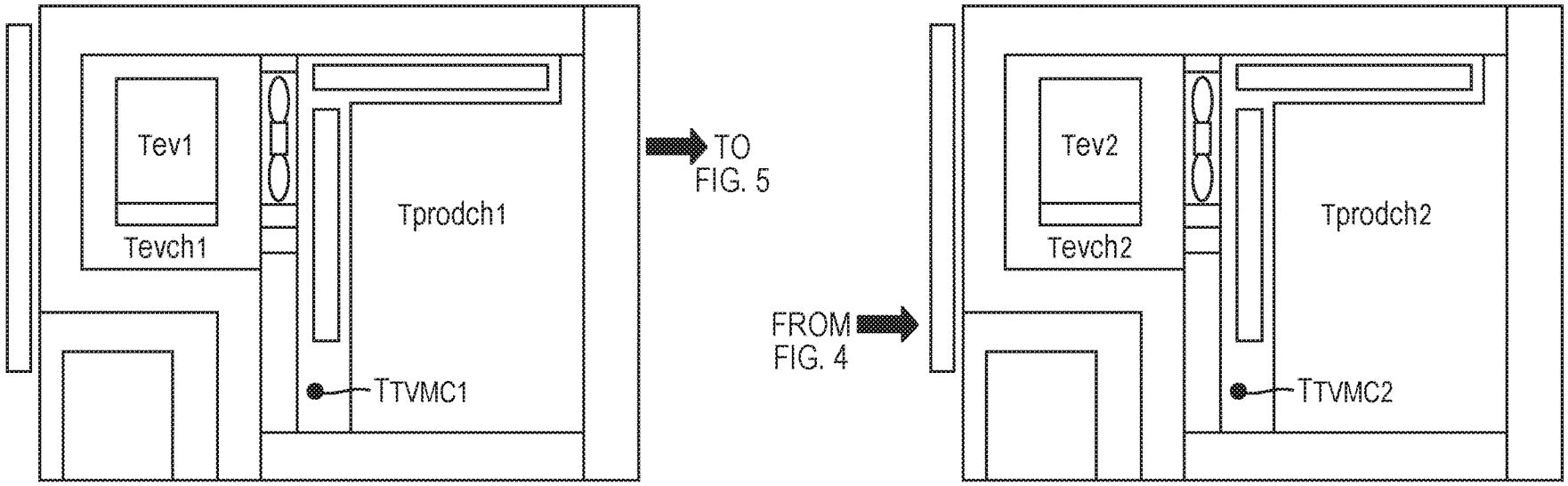
FIG. 4 is an illustration of State i temperatures.
FIG. 5 is an illustration of State ii temperatures.

Referring now to FIGS. 4 and 5 which shows the transition from State (i) and State (ii) temperatures as the system cycles from the steady-state to the heating defrost mode. $T_{EV}$2 becomes greater than the freezing point of water. The temperature of evaporator 6 elevates to a design temperature for defrosting. The temperature $T_{EVCH}$2 becomes less than $T_{EV}$2 wherein evaporator 6 heats the surrounding air in the evaporator chamber 20. The temperature of $T_{RVMC}$2 becomes much less than the temperature of $T_{EV}$2. Thus, the temperature of thermal reservoir 10 maintains a low temperature in TVMC 12. Then, the temperature of $T_{PRODCH}$2 becomes greater than the temperature of $T_{TVMC}$ 2 but this temperature is lower than the required product 15 storage temperature. (Typically, this temperature is below the freezing point of water).

Process and Thermo-Physical Effects in the Defrost Mode

Fan 7 operation is halted. This prevents convection and greatly reduces air transport between the three chambers; that is, evaporator chamber 20, TVMC 12 and product chamber 14. The hot gas or heating element 19 is engaged in warming evaporator 6 to temperature $T_{EV}$2. The temperature of evaporator chamber 20 is warmed to $T_{EVCH}$2. Finally, the temperature of product chamber 14 reaches $T_{PRODCH}$2. All frost on evaporator 6 liquefies and drips off or turns to vapor. Similarly, frost on evaporator chamber 20 walls of the system liquefies and drips off or turns to vapor. The water then drips and runs out of the system. TVMC 12 acts as a barrier to free convection between evaporator chamber 6 and product chamber 14. Thermal reservoirs 10, located within TVMC 12, act as a thermal barrier absorbing heat caused by defrost heating and heat through the insulated freezer housing 1. These walls during the defrost cycle maintain the temperature of product chamber 14 to ensure the air temperature surrounding product 15 stays within the recommended range. A nominal amount of vapor migrates from evaporator chamber 20 to the other chambers within the system. What vapor is transported due to free convection is intercepted in the TVMC 12. It is cooled and or condensed as frost on the surfaces of TVMC 12 (plenum walls 11 and thermal reservoirs 10 and packaging surfaces of product 15).

Phase iii—Drip Delay and Evaporator Cool-Down Mode

Figure 7:
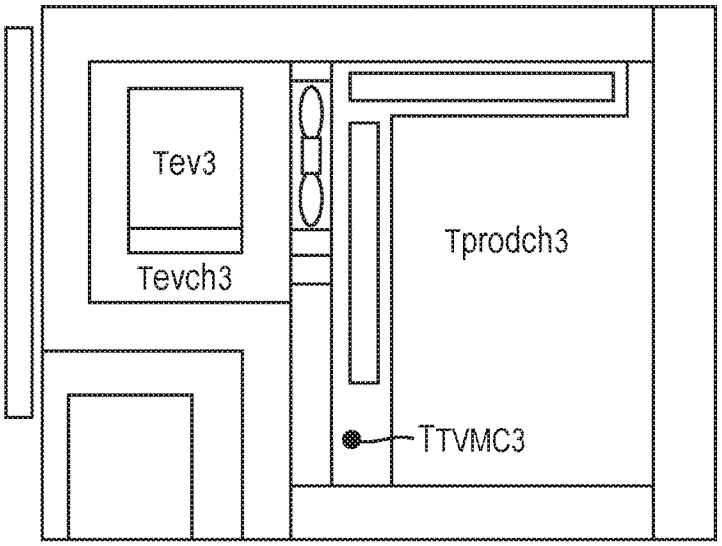
FIG. 7 is an illustration of State iii temperatures.
Figure 6:
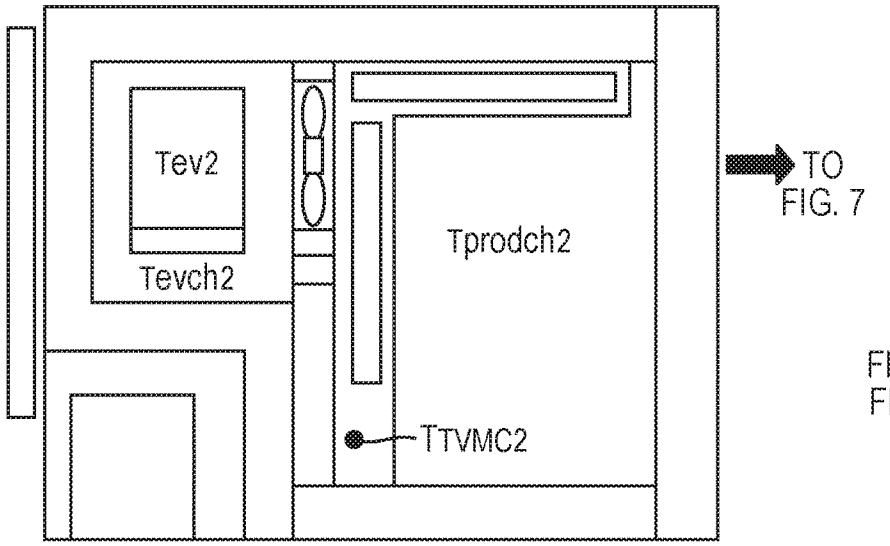
FIG. 6 is an illustration of State ii temperatures.

Referring now to FIGS. 6 and 7, the description looks at the temperature changes occurring as the system changes from State 2 to State 3. The temperature of $T_{EV}$3 becomes less than the temperature of $T_{EV}$2; in other words, evaporator 6 cools. The temperature of $T_{EVCH}$3 becomes approximately equal to temperature of $T_{EV}$3. The temperature of $T_{EV}$3 is less than the temperature of $T_{EV}$2. Thus, the temperature of evaporator chamber 20 cools. The temperature of $T_{TVMC}$ 3 is approximately equal to $T_{TVMC}$ 2. $T_{TVMC}$ 2 is much less than the temperature $T_{EV}$3. Thermal reservoirs 10 continue to maintain a low temperature within TVMC 12. Finally, the temperature of $T_{PRODCH}$3 is approximately equal to the temperature of $T_{PRODCH}$2. The temperature of $T_{PRODCH}$2 is greater than $T_{TVMC}$ 2 but lower than the required storage temperature of product 15 which is typically below the freezing point of water.

Process and Thermo-Physical Effects of this Mode

The active heated defrost cycle ends. Water continues to drip, drain or evaporate. Evaporator chamber 20 cools down due to the cooler temperatures of the surrounding components (driven by heat absorption to the surrounding components thermal capacities) and thermal reservoirs 10 which continues to absorb heat via phase transition. The air in evaporator chamber 20 achieves a temperature below the freezing point of water before fan 7 engages for the next phase (refrigeration restart). Then, the drip cycle ends. Most of the water vapor in evaporator chamber 20 condenses during this phase as frost on evaporator 20, and walls and cooled evaporator surfaces prior to induced air circulation into TVMC 12 and product chamber 14. The vapor transport is greatly reduced from the heated evaporator chamber 20 and other surfaces.

Phase iii—Refrigeration Restart

Figure 9:
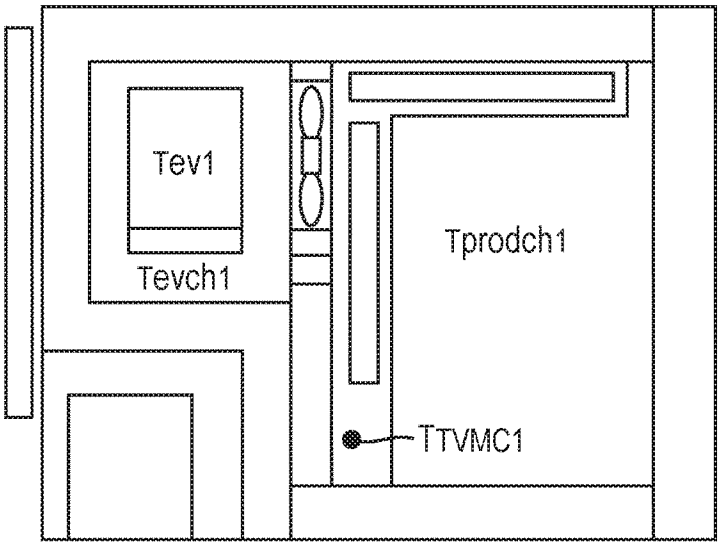
FIG. 9 is an illustration of State i temperatures.
Figure 8:
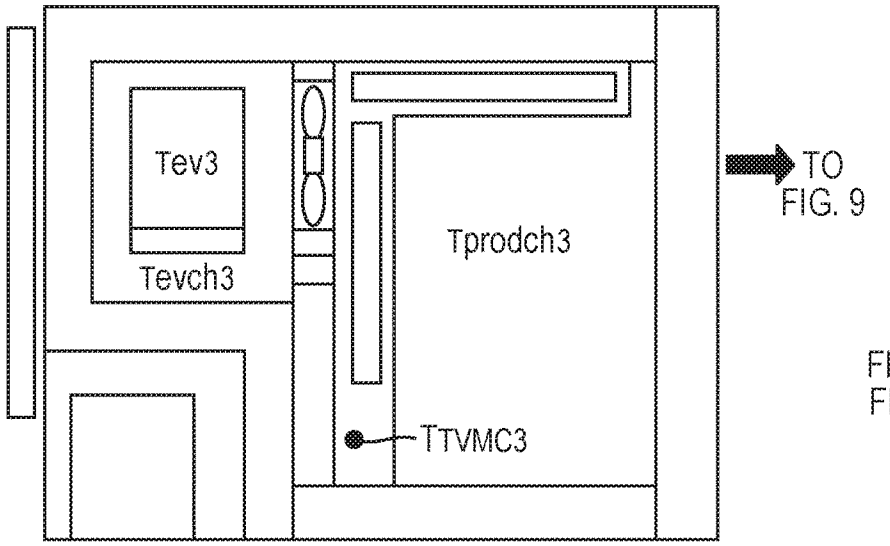
FIG. 8 is an illustration of State iii temperatures.

Now referring to FIGS. 8 and 9, the system temperatures found in this phase are described as the system goes from State (iii) to State (i). The temperature of $T_{EV}$1 is much less than the temperature of $T_{EV}$3. The temperature of evaporator 6 cools down due to active refrigeration. The temperature of $T_{EVCH}$1 is much less than the temperature of $T_{EV}$3. Evaporator chamber 20 is then cooling down due to active refrigeration. The temperature of $T_{TVMC}$ 1 is less than the temperature of $T_{TVMC}$ 3. Thermal reservoirs 10 freeze due to the active cooling. Finally, $T_{PRODCH}$1 is greater than $T_{PRODCH}$3. Product storage chamber 14 then cooled down due to active refrigeration.

Process and Thermo-Physical Effects of this Phase

Compressor 4 then restarts thus inducing active refrigeration. Evaporator 6 temperature pulls down to normal operating steady-state temperature. After a timed-delay, fan 7 restarts and induces airflow within all chambers. The temperature in product chamber 14 pulls down to normal steady-state operating temperature. The temperature in thermal reservoirs 10 pulls down to normal operating steady-state temperature. Reservoirs 10 absorb latent heat required for the solidification phase transition and continues to drop in temperature to a frozen solid. The bulk of the vapor in the system (evaporator chamber 20, TVMC 12 and product chamber 14 quickly condenses onto evaporator 6 due to the rapid temperature drop relative to other internal components prior to fan 7 restarting.

It is at this stage that a great differential in vapor partial pressure driven sublimation begins to accelerate. Since thermal reservoir 10 requires a significant tonnage of refrigeration after the defrost cycle to pull down to phase transition temperature and then to supply the latent heat of phase transition, product chamber 14 stays at a higher temperature relative to evaporator chamber 20. Evaporator 6 has a longer timeframe than would be experienced with a standard freezer with an auto-defrost capability.

The effect of this longer timeframe with a greater average temperature differential is to drive accelerated sublimation in product chamber 14. This is due to the greatly reduced vapor partial pressure thus setting up a high driving potential. The effect of the overall process cycle (all States included) is to continually reduce the total ice and vapor content within the three chambers (evaporator chamber 20, TVMC 12, and product chamber 14) comprising a closed system of the Controlled Auto-Defrost Freezer by continually moving through sublimation any ice and, then, purging ice and frost with each given defrosting cycle.

Although the present invention has been described with reference to certain preferred embodiments thereof, other versions are readily apparent to those of ordinary skill in the preferred embodiments contained herein.

What is claimed is:

1. A refrigeration defrost system for a refrigerator wherein said refrigeration defrost system is used for storage of vaccines or other products having such low temperature storage requirements, said refrigeration defrost system comprises:

a digital controller for measuring temperatures and regulating the operation of the refrigeration system including initiating a refrigeration defrost cycle;

a condenser having metal tubing ranging in length from 180 to 240 inches;

a hermetically sealed compressor;

an evaporator having metal tubing ranging in length of 80 to 160 inches; wherein said evaporator further having fins for heat transfer and an integrated heating element and an expansion device, wherein said evaporator is positioned in an evaporator chamber; when said heating element of said evaporator becomes hot when subjected to an electrical current;

a product storage chamber for storing vaccines or other products having low temperature storage requirements;

an axial airflow induction fan;

a temperature variance moderation chamber (hereinafter TVMC);

a plurality of thermal reservoirs arranged and disposed in the TVMC;

a dividing plenum wall dividing said TVMC from said product storage chamber, wherein the evaporator chamber is separated from the product storage chamber by the TVMC, the plurality of thermal reservoirs of the TVMC and the dividing plenum wall acting as a thermal barrier between the evaporator chamber and the product storage chamber;

and wherein the volume of said product storage chamber to the volume of said TVMC has a range from 3 to 5.5; and wherein the volume of the product storage chamber relative to said thermal reservoirs total latent heat ratio has a tolerance zone of 0.1 to 1.5 (in3/J/g)); and wherein the temperature of said product storage chamber maintains a temperature of −58 degrees Centigrade and −15 degrees Centigrade during the defrost cycle of the refrigerator.

2. The refrigeration defrost system of claim 1 wherein said TVMC further comprises a dividing plenum wall; a plurality of integrated clips and a plurality of vents positioned to induce convection and sized to optimize thermal transfer to said plurality of said thermal reservoirs.

3. The refrigeration defrost system of claim 2 wherein said TVMC is adjacent to said product storage chamber.

4. The refrigeration defrost system of claim 3 wherein said axial induction fan is approximately 3.5 inches in diameter.

5. The refrigeration defrost system of claim 4 wherein the plurality of thermal reservoirs is four.

6. The refrigeration defrost system of claim 5 wherein the freezing point temperature in said plurality of thermal reservoirs has a minimum delta of zero degrees Centigrade to a maximum delta of −20 degrees Centigrade of the stored product when the stored product is a vaccine.

7. The refrigeration defrost system of claim 6 such that when the temperature of said TVMC and the temperature of said product storage chamber is reduced to the operating range, said plurality of thermal reservoirs loose heat through the process and freeze.

8. The refrigeration defrost system of claim 7 when said digital controller initiates said refrigeration defrost cycle, said plurality of thermal reservoirs absorb heat via free convection in said product storage chamber and maintain the temperature of said product storage chamber below the specified maximum allowed vaccine storage temperature throughout said refrigeration defrost cycle.

9. The refrigeration defrost system of claim 8 wherein said axial induction fan will not be engaged by said digital controller until the air temperature around said evaporator and said evaporator chamber has dropped in temperature ranging from 5 degrees to 20 degrees Fahrenheit after the refrigeration defrost system has undergone said refrigeration defrost cycle defrost cycle.

10. The refrigeration defrost system of claim 9 wherein said plurality of thermal reservoirs and said plenum dividing wall create a barrier between a thermal barrier between said evaporator and said product storage chamber such that the temperature increase induced by said integrated heating element during said refrigeration defrost cycle does not adversely affect the stored product.

* * * * *